US011690769B2

(12) United States Patent
Dennie

(10) Patent No.: US 11,690,769 B2
(45) Date of Patent: Jul. 4, 2023

(54) PORTABLE BODY-WASHING APPARATUS

(71) Applicant: Dwain Dennie, Jonesboro, GA (US)

(72) Inventor: Dwain Dennie, Jonesboro, GA (US)

( * ) Notice: Subject to any disclaimer, the term of this patent is extended or adjusted under 35 U.S.C. 154(b) by 10 days.

(21) Appl. No.: 17/579,906

(22) Filed: Jan. 20, 2022

(65) Prior Publication Data

US 2022/0226173 A1 Jul. 21, 2022

Related U.S. Application Data

(60) Provisional application No. 63/199,731, filed on Jan. 20, 2021.

(51) Int. Cl.
*A61G 5/10* (2006.01)
*A61G 7/00* (2006.01)

(52) U.S. Cl.
CPC ..... *A61G 5/1002* (2013.01); *A61G 7/0005* (2013.01)

(58) Field of Classification Search
CPC .... A61G 5/1002; A61G 7/0005; A47K 3/122; A47K 3/282; A61H 33/6021; A47C 7/626
USPC ..... 4/377, 616
See application file for complete search history.

(56) References Cited

U.S. PATENT DOCUMENTS 2,033,023 A * 3/1936 Brown ..... A47K 3/287 4/618
3,040,335 A * 6/1962 Gellmann ..... A47K 3/122 4/570
3,528,112 A * 9/1970 Warnick ..... A47K 3/12 4/447
5,025,515 A * 6/1991 Rhines ..... A61G 7/0005 4/584
6,195,814 B1 * 3/2001 Yoshida ..... A47K 3/282 4/601
10,813,506 B1 * 10/2020 Mitrano ..... A47K 3/282
11,607,084 B2 * 3/2023 Williams ..... A47C 11/005
2004/0070237 A1 * 4/2004 Wilson ..... A47K 3/282 297/180.15
2011/0061159 A1 * 3/2011 Mardirossian ..... A47K 3/282 4/611
2011/0283450 A1 * 11/2011 Fainberg ..... A47K 3/122 4/579
2013/0305449 A1 * 11/2013 Allos ..... B05B 1/18 4/615
2014/0250587 A1 * 9/2014 Alsaffar ..... A47K 13/005 4/615
2017/0128322 A1 * 5/2017 Fassihi ..... A61P 17/00
2019/0159633 A1 * 5/2019 Lee ..... A47K 3/006
(Continued)

*Primary Examiner* — Benjamin R Shaw

(57) ABSTRACT

A portable body-washing apparatus is a self-supported, self-contained hygiene aid directed towards use in care-homes, hospitals, or other facilities typically tasked with assisted bathing of disabled persons. A mobile chassis supports an adjustable armature, a base chair segment, and at least one articulated chair segment to support a subject's body during washing. An onboard pump assembly and connected power supply feeds fluids from at least one fluid source through a plurality of conduits via a fluid selection source, enabling operators to select from various output modes, e.g., water, heated air, body wash, shampoo, et cetera. The plurality of conduits is connected to a plurality of outlet heads distributed across the base chair segment and at least one articulated chair segment to enable a full-body wash without requiring a caregiver to physically maneuver the patient.

20 Claims, 11 Drawing Sheets

(56) References Cited

U.S. PATENT DOCUMENTS

| | | | | |
|---|---|---|---|---|
| 2021/0145218 | A1* | 5/2021 | Shyka | A61H 33/6021 |
| 2022/0226845 | A1* | 7/2022 | Dennie | B05B 7/2491 |
| 2022/0378253 | A1* | 12/2022 | Williams | A47K 3/282 |
| 2022/0386827 | A1* | 12/2022 | Crossing | A47K 7/08 |
| 2023/0029813 | A1* | 2/2023 | Branch | A47K 3/282 |

* cited by examiner

PORTABLE BODY-WASHING APPARATUS

FIELD OF THE INVENTION

The present invention generally relates to a shower device. More specifically, the present invention relates to a medical shower scooter that facilitates the showering and bathing of physically challenged persons.

BACKGROUND OF THE INVENTION

A medical shower scooter is in demand. Many people become physically challenged with age, injury, or disease. Such people include amputees, cancer patients, hospice patients, and other bed-ridden patients who encounter difficulty in bathing or showering. For example, people might have trouble standing in a shower stall or a bathtub while taking a shower without gripping handrails on the inside of the bathtub or shower, if available. Such persons can easily collapse during a shower or might not have the strength to take a shower in the first place.

Companies have developed various devices for supporting a person in a sitting position while bathing or showering. Some companies have developed a device that provides an entrance mechanism to the bathtub or shower for physically challenged users. However, such devices may necessitate major structural changes to the existing bathing or showering facility and/or the surrounding wall or floor area. Permanent modification of an existing bathing or showering facility may be undesirable from cost and other standpoints. Moreover, many conventional solutions to the problem may not enable a physically challenged user to obtain a full-body wash, especially when the person needs to move from one place to another. In a bathroom or a hospital facility, for example, a physically challenged person might not be able to move around during the shower even if he or she needs to. Thus, there is a need to develop a device that solves the problem.

The present invention is intended to address problems associated with and/or otherwise improve on conventional devices through an innovative shower device that is designed to provide physically challenged people with mobility and a convenient, effective means of showering while incorporating other problem-solving features.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIG. 1 through 11, the present invention is a portable body-washing apparatus configured to support basic hygiene for invalid or mobility-compromised individuals. In particular, use of the present invention is directed towards reducing the incidence of skin lesions, surface infections, or fungal growth in patients that may otherwise suffer from a lack of regular, effective washing of sensitive areas. In contrast to manual sponge-bathing or conventional shower systems, the present invention integrates an effective, ergonomically-sound means of washing a seated patient or subject into a mobile self-supported package across a variety of embodiments.

Figure 1:
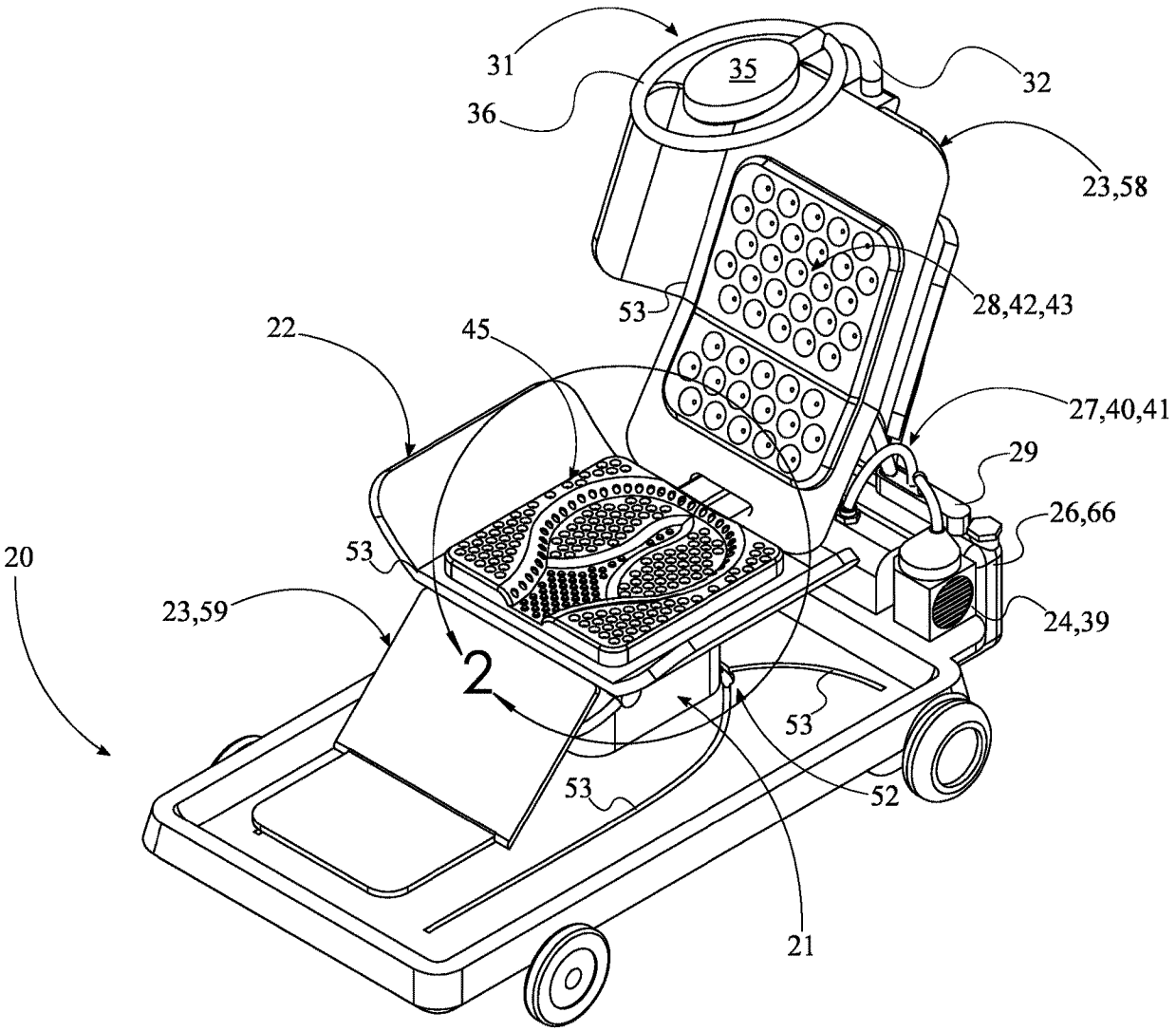
FIG. 1 is a top-front-left perspective view of one embodiment of the present invention.

As shown in FIG. 1, the present invention comprises a mobile chassis 20, an adjustable armature 21, a base chair segment 22, and at least one articulated chair segment 23. The mobile chassis 20 provides a convenient and displaceable chair or tilting-bed form factor suitable for use in healthcare settings, particularly in cases wherein the patients or subjects utilizing the present invention have compromised mobility that would make conventional shower facilities impractical. The adjustable armature 21 further refers to the ergonomic, user-configurable body supports positioned on the mobile chassis 20 to effectively support and cradle a user's body. The base chair segment 22 specifically refers to the main seating area or cushioned surface generally analogous to a stool or other chair base. The at least one articulated chair segment 23, in contrast, defines a reclinable or otherwise reconfigurable support structure for the user's upper and lower body.

Figure 5:
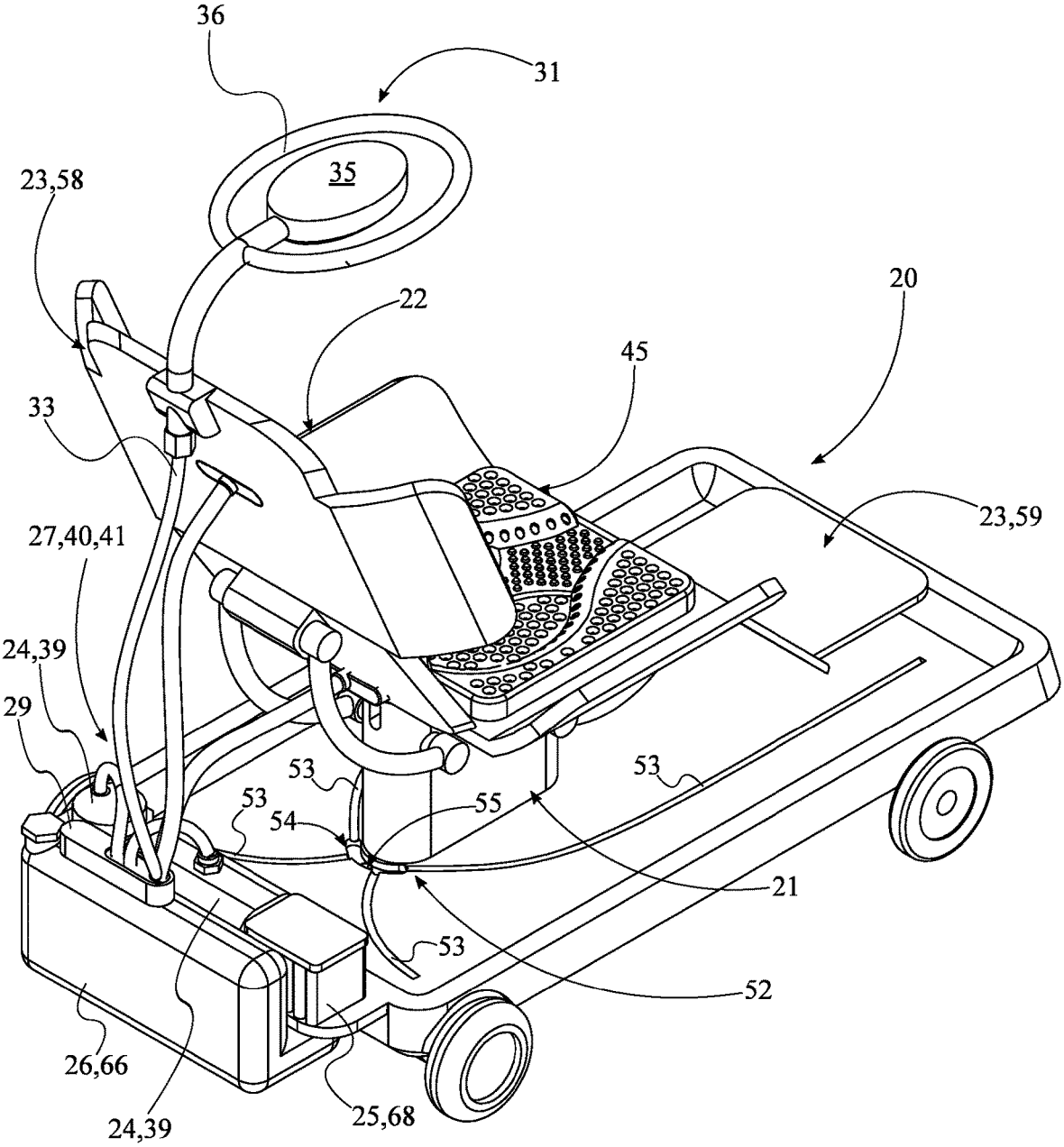
FIG. 5 is a top-rear-right perspective view thereof.
Figure 8:
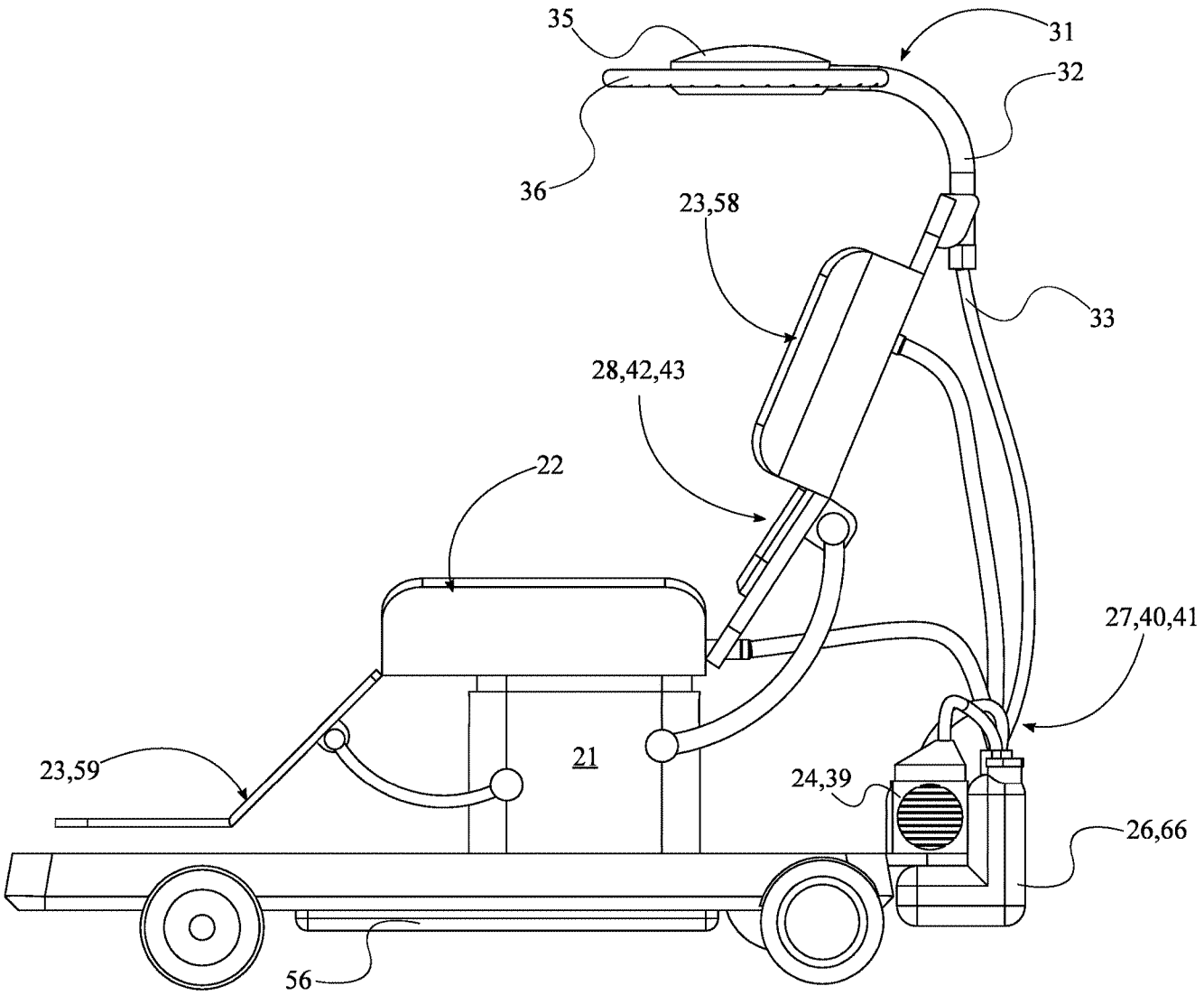
FIG. 8 is a left-side elevational view thereof.

As shown in FIGS. 5 and 8, the adjustable armature 21 is mounted to the mobile chassis 20. The base chair segment 22 and the at least one articulated chair segment 23 are mounted to the adjustable armature 21 by extension. The relative position of the base chair segment 22 to the mobile chassis 20 is configurable by adjusting the extension of the adjustable armature 21, including both elevation and tilt. Further, the at least one articulated chair segment 23 may be adjusted to support a user's upper body independent of the base chair segment 22. In the preferred embodiment shown, the base chair segment 22 is adjustable on a piston or adjustable stanchion, and the at least one articulated chair segment 23 is configured as a rotatable arm configurable for both upright-seated and flat (prone or supine) orientations relative to the base chair segment 22. The relative position of the base chair segment 22, and the at least one articulated chair segment 23, to the mobile chassis 20 are independently configurable to enable the broadest range of movement between the 'floating' body support in all conceivable configurations.

In various embodiments, the base chair segment 22 is configured for independent positioning relative to the mobile chassis 20, particularly in cases wherein a mobility-compromised user may require assistance standing up from said base chair segment 22. In this embodiment, the base chair segment 22 may be elevated or tilted to accommodate the user, enabling a controlled rearward 'drop' into a normal seating position. Likewise, the at least one articulated chair segment 23 may be continuously repositioned during this modified seating process to support the user's upper body, without otherwise impeding access to the base chair segment 22.

Figure 6:
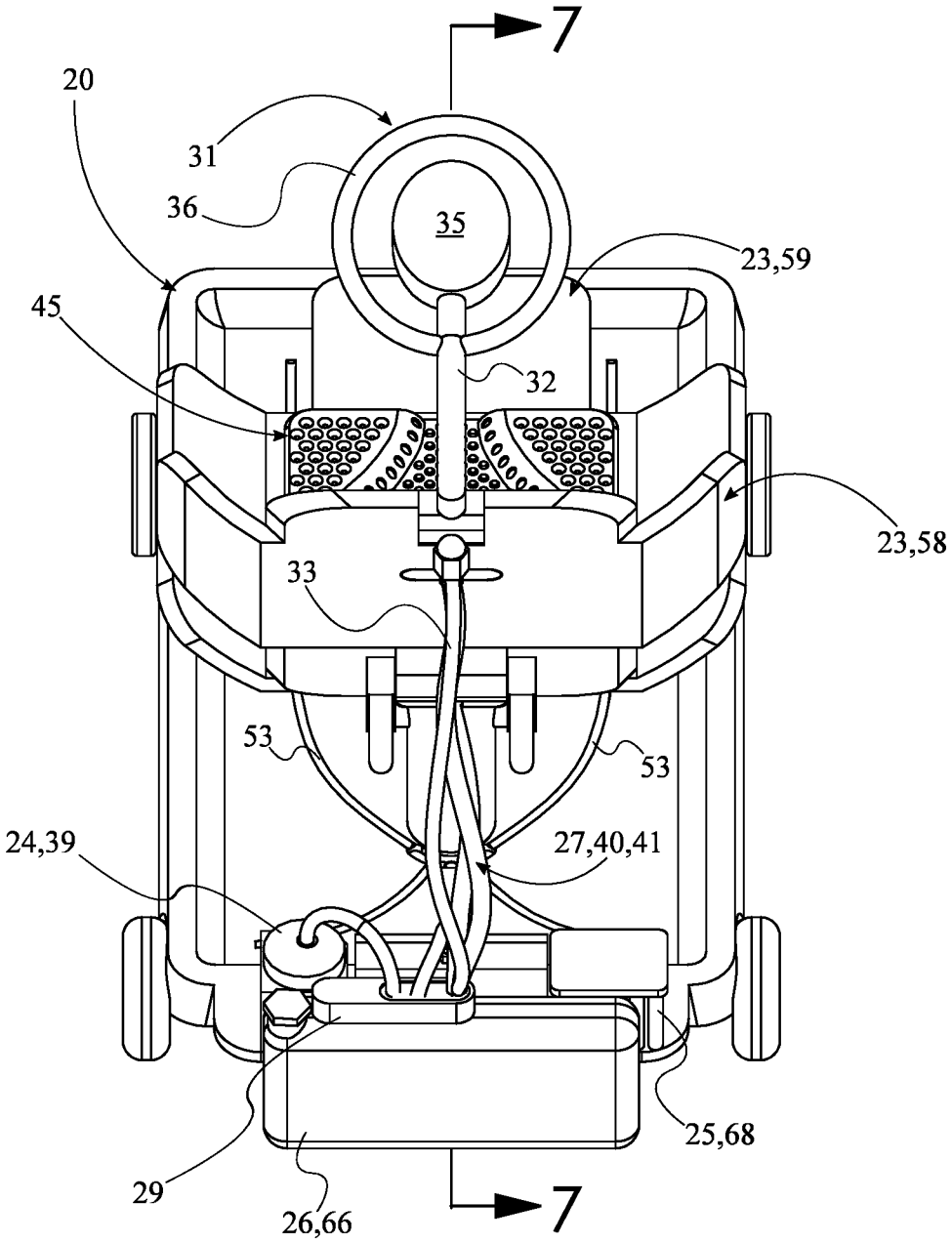
FIG. 6 is a top-rear perspective view thereof.
Figure 7:
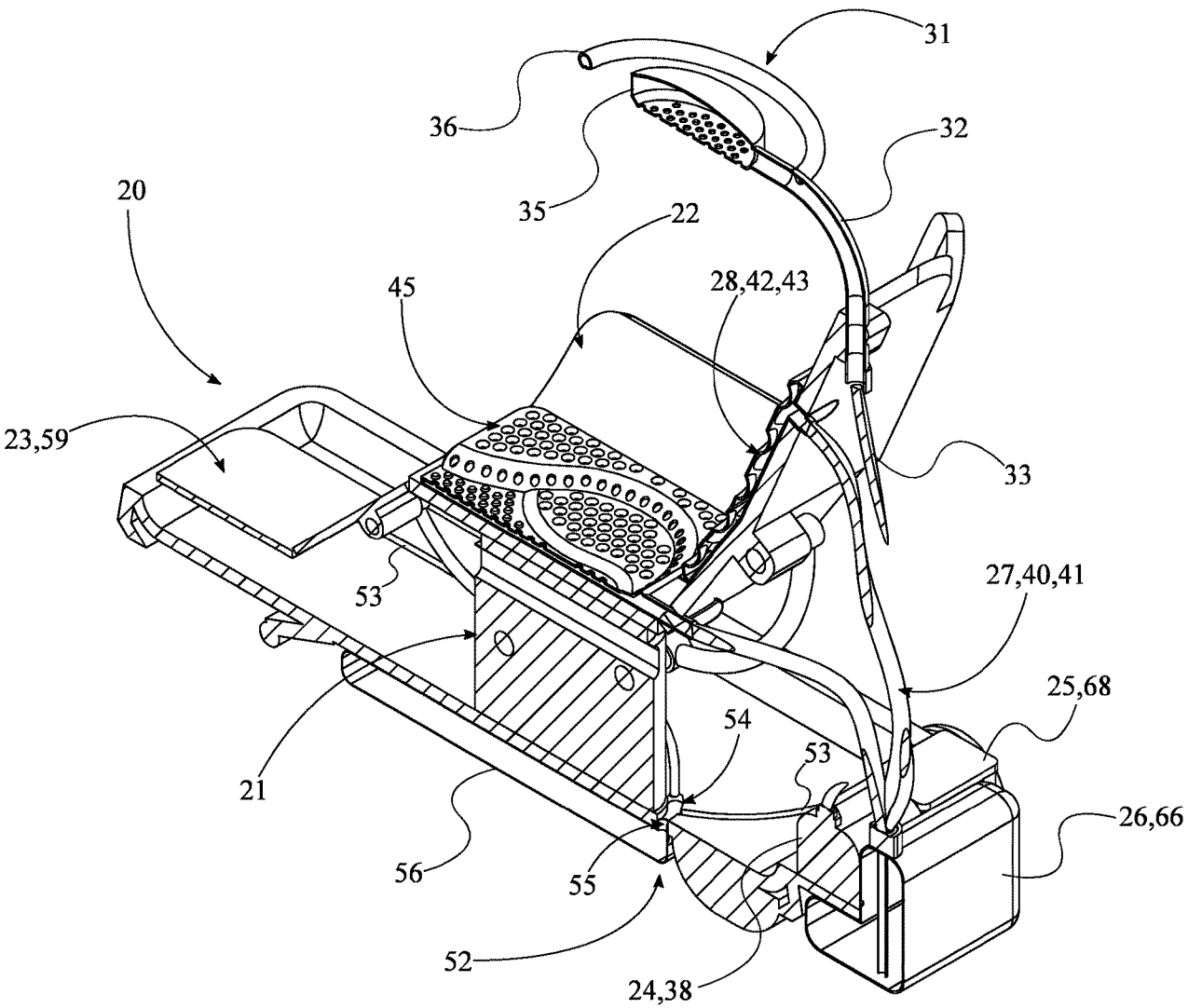
FIG. 7 is a section view taken along line 7-7 in FIG. 6.

In reference to FIG. 5 through 7, the present invention further comprises a pump assembly 24, a power supply 25, at least one fluid source 26, a plurality of conduits 27, a plurality of outlet heads 28, and a fluid selection mechanism 29. The pump assembly 24 is mounted to the mobile chassis 20 to enable any instance of the present invention to remain mobile as a complete unit. Accordingly, the power supply 25 is electrically connected to the pump assembly 24 to provide operating power to the pump assembly 24, and the pump assembly 24 is in fluid communication with the at least one fluid source 26. The power supply 25 and the at least one fluid source 26 are broadly contemplated to define both onboard and external elements in various embodiments. In a first embodiment, the power supply 25 and the at least one fluid source 26 constitute external sources of electrical energy and potable water for washing, respectively. Connection to these external items is facilitated by any means common or familiar to any reasonably skilled individual. In a second embodiment, the power supply 25 and the at least one fluid source 26 are mounted to the mobile chassis 20 to enable the present invention to function without any external support or supply, i.e., as a fully self-supported platform.

According to the second embodiment of the power supply 25 outlined above, the present invention is packaged with all necessary provisions and materials to operate unsupported and untethered. the power supply 25 is a battery array 68, wherein the battery array 68 is mounted to the mobile chassis 20 as shown in FIG. 5. This arrangement may also constitute a hybridized approach to providing electrical power when operated in conjunction with external sources of power, including both grid-connections and on-site generators of said power. In these arrangements, the battery array 68 is utilized to levelized and regulate input and output power to ensure a stable supply or operating energy for the pump assembly 24. This configuration is particularly suitable for use with localized generators, weak local grids, and other forms of unstable electrical power that may be provided in less-than-optimal conditions.

Likewise, the second embodiment of the at least one fluid source 26 is a portable reservoir 66 in this second embodiment. As shown in FIG. 8 the portable reservoir 66 is mounted to the mobile chassis 20 to provide a continuous supply of fresh water or washing fluid to the pump assembly 24. The use of a portable reservoir 66 in place of a dedicated connection to a local water supply enables the present invention to operate throughout a facility, e.g., making room calls rather than gathering all patients at a bathing facility with a suitable water hookup. Further, the portable reservoir 66 may be used to premix various cleansers, soaps, or other cleaning agents into the wash-water even when used in conjunction with a dedicated water line hookup. In this configuration, the portable reservoir 66 serves as a surge tank or expansion chamber for any incoming water pressure, normalizing outflow to the pump assembly 24. This ideally extends the operating lifespan of the pump assembly 24 by both prechecking and prefiltering any incoming water within the portable reservoir 66, preventing damage due to debris or irregular flow (e.g., water hammer, cavitation, aeration, etc.).

In reference to FIGS. 1 and 7, the plurality of outlet heads 28 is distributed across the base chair segment 22 and the at least one articulated chair segment 23 to expose the greatest possible surface area of a subject's body to the plurality of outlet heads 28. This distribution enables a full-body wash without requiring immersion into a tub or washbasin, minimizing water use per person. Further, the plurality of outlet heads 28 may be configured for a hydrotherapy or massage-type application, wherein each of the plurality of outlet heads 28 are independently moderated for pressure and output volume. In the broadest reasonable conception of the present invention, the plurality of outlet heads 28 defines any form of fluid dispersion head or diffuser suitable for use in-contact with a user's body. More specifically, each of the plurality of outlet heads 28 is configured to prevent total blockage when in contact with a subject's body by recessing or otherwise protecting the outflow paths of each of the outlet heads such that the user may not totally block the flow of water out of any of the plurality of outflow heads. This feature ideally provides a constant flow of pressurized water against the subject's skin, effecting a 'touchless' bath with a minimum of wasted water.

Figure 9:
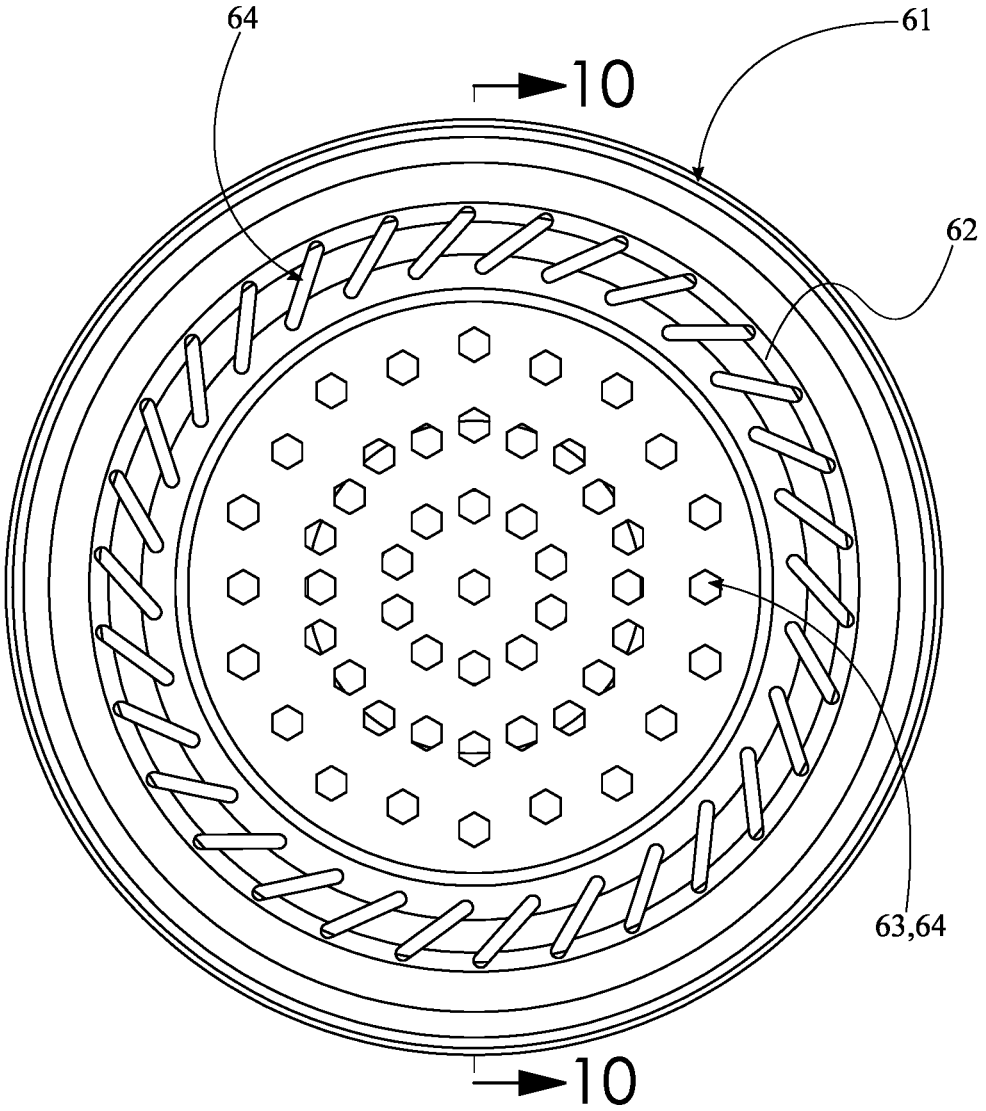
FIG. 9 is a front elevational view of a singular outlet head from the plurality of outlet heads
Figure 10:
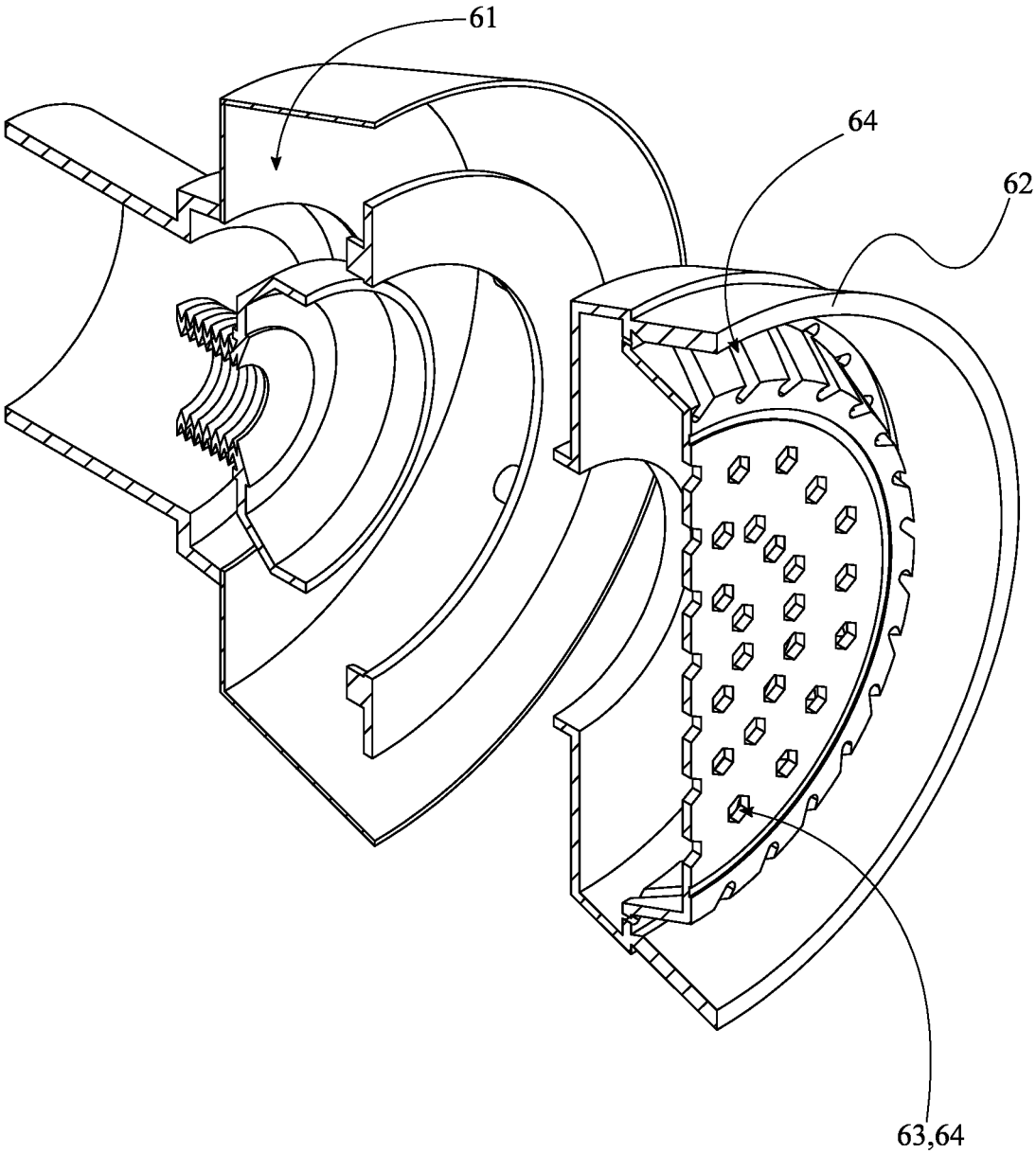
FIG. 10 is an exploded section view taken along line 10-10 in FIG. 9.
Figure 11:
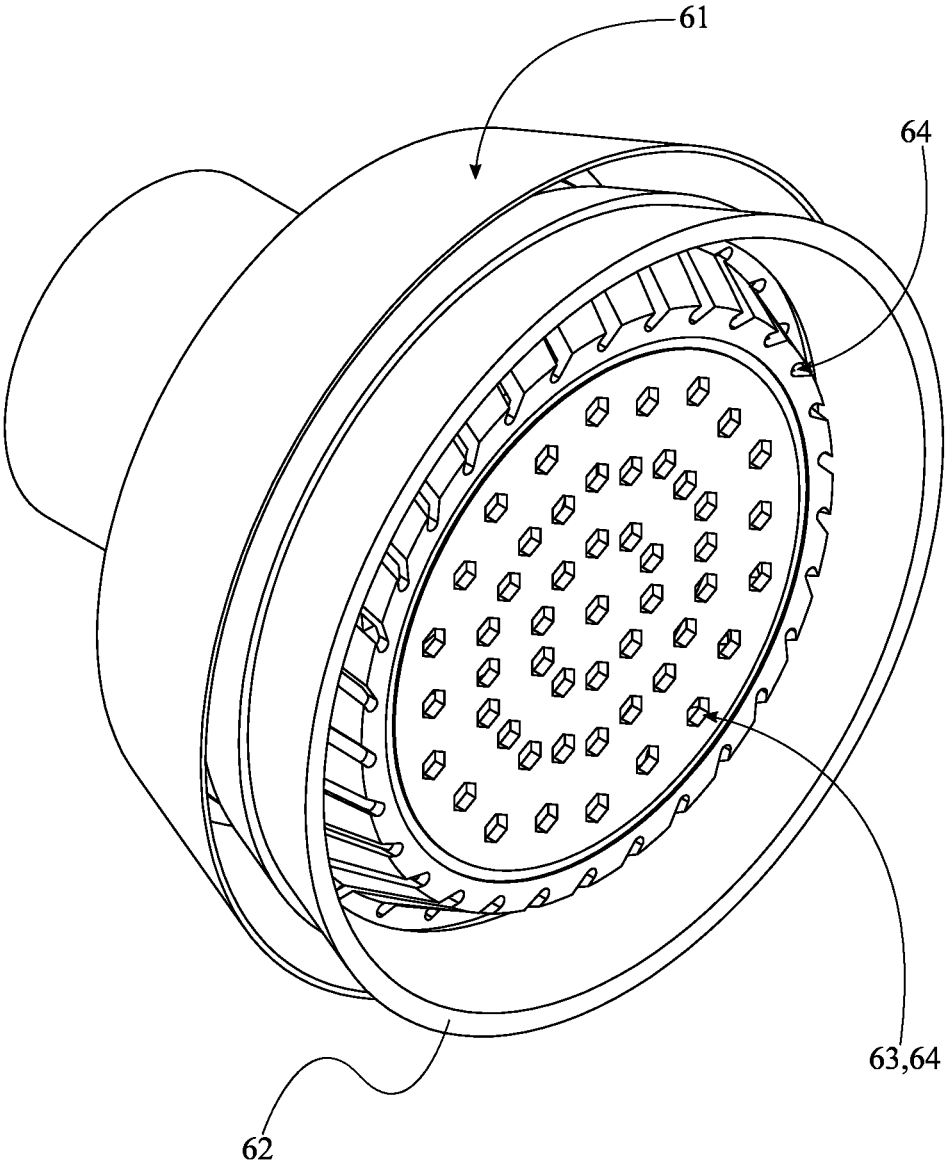
FIG. 11 is a top-front-right perspective view thereof.

In another embodiment, each of the plurality of outlet heads 28 is configured to independently function as a compressible, flexible member capable of deforming to cradle the patient's body. As indicated in FIG. 9 through 11, each of the plurality of outlet heads 28 further comprises a compressible housing 61, a nozzle plate 62, a plurality of air jets 63, and a plurality of fluid jets 64. The nozzle plate 62 is mounted into the compressible housing 61, wherein the compressible housing 61 is configured to expand under pressure. Cumulatively, this functionality creates a reactive pseudo-cushion within each of the plurality of outlet heads 28. This arrangement further provides a means for efficient distribution of fluid output, as obstruction of any given instance of the plurality of outlet heads 28 increases pressure to any unobstructed set thereof, increasing the effective volume of the unobstructed set to cushion the user more effectively. In this way, the plurality of outlet heads 28 is configured as an analog auto-normalizing suspension system in parallel to the regular functionality of fluid output.

As indicated in FIG. 9, the plurality of air jets 63 and the plurality of fluid jets 64 are distributed across the nozzle plate 62, wherein the plurality of air jets 63 and the plurality of fluid jets 64 are in fluid communication with the pump assembly 24 through the plurality of conduits 27. The plurality of air jets 63 and the plurality of fluid jets 64 ideally define differing aperture profiles such that the plurality of fluid jets 64 provides a normalized spray pattern from all apertures as the compressible housing 61 becomes pressurized. Conversely, the plurality of air jets 63 is generally configured to disperse warm air (i.e., as a forced-air dryer) in a forward-directed pattern, presuming that the lower density of air vs. fluid enables the volume of heated air to project directly outward from the plurality of air jets 63. By leveraging the varying density of outputs, the plurality of air jets 63 and the plurality of fluid jets 64 may function as specialized dispersal structures while still sharing a common plenum area.

As shown in FIGS. 5 and 6, the plurality of conduits 27 is connected to the pump assembly 24 to provide a secure means of transferring pressurized fluids to each of the plurality of outlet heads 28. More specifically, each of the plurality of outlet heads 28 is connected to one of the plurality of conduits 27, wherein plurality of outlet heads 28 is in fluid communication with the at least one fluid source 26 through the plurality of conduits 27. It is broadly considered that the type and variety of cables, tubing, expansion chambers, or other fluid transmission components defined within the plurality of conduits 27 is adapted or adaptable to handle any type of fluid typically used in personal hygiene. The present invention is ideally capable of outputting both liquids and pressurized air under the operating term 'fluid', providing a means of washing, drying, or otherwise treating a subject utilizing the same collection of fluid-handling assemblies as described.

Further, an operator of the present invention may select and adjust from any type of input fluid to dispense the desired type and volume of said fluid from the plurality of outlet heads 28. Accordingly, the fluid selection mechanism 29 is connected between the pump assembly 24 and the at least one fluid source 26, wherein the fluid selection mechanism 29 moderates input to the pump assembly 24 from the at least one fluid source 26. This control is ideally exercised via a solenoid-actuated valve body, whereby the type and volume of fluid is digitally controlled according to a programmed mode of use. Further, the fluid selection mechanism 29 enables the admixture of differing types of fluid prior to dispersion via the plurality of outlet heads 28, e.g., the addition of a soap solution to water flow or the introduction of an aromatic to a volume of heated air.

In addition to the plurality of outlet heads 28 distributed across the body-adjacent sections of the present invention, the subject may be washed from overhead utilizing a dedicated module intended for hair-washing and the like. As shown in FIG. 8, the present invention further comprises an overhead module 31, an elevated support 32, and at least one dedicated conduit 33 from the plurality of conduits 27. The elevated support 32 is mounted to the at least one articulated chair segment 23, wherein the elevated support 32 extends above the at least one articulated chair segment 23 and the base chair segment 22. The overhead module 31 is mounted to the elevated support 32, opposite the at least one articulated segment, positioning the overhead module 31 approximately above a user's head when said using is seated. The at least one dedicated conduit 33 is connected between the overhead module 31 the pump assembly 24 through the elevated support 32. In a first embodiment, the at least one dedicated conduit 33 constitutes any arbitrary conduit form the plurality of conduits 27, wherein the overhead module 31 is operated as a functional continuation of the plurality of outlet heads 28. In a second embodiment, the at least one dedicated conduit 33 is moderated separately from the rest of the plurality of outlet heads 28, thereby enabling an operator to provide a specialized mixture of fluids thereto. For example, this enables the overhead module 31 to dispense shampoo while the plurality of outlet heads 28 dispenses a body wash, according to the intended functions of each separate component.

Figure 4:
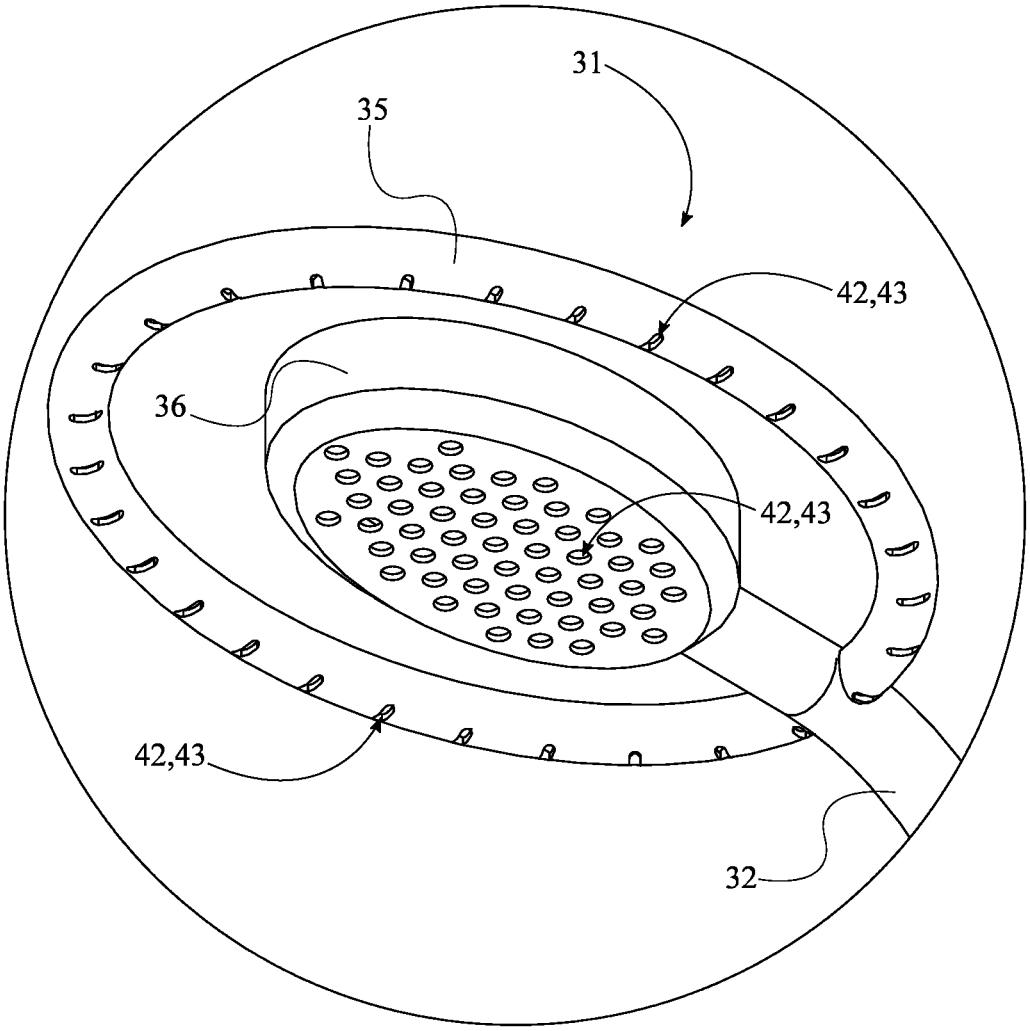
FIG. 4 is a detail view of area 4 from FIG. 3.

In the prefeed embodiment shown in FIG. 4, the overhead module 31 further comprises a central head 35 and an outer ring 36. The outer ring 36 and the central head 35 are mounted to the elevated support 32 with the central head 35 positioned within the outer ring 36. As indicated in FIG. 7, the interior of the central head 35 and the outer ring 36 are hollow and share a common plenum space. When pressurized by the at least one dedicated conduit 33 the outer ring 36 and the central head 35 collectively dispense any fluid therefrom in a halo-pattern above a subject, effectively covering the subject's head from all angles. In another embodiment, the outer ring 36 and the central head 35 are moderated and supplied separately, enabling the providing of different types of fluid onto a subject's head simultaneously.

In further exploration of the various types of fluids handles by the pump assembly 24, the pump assembly 24 further comprises a fluid pump 38 and an air pump 39 as indicated in FIG. 6. Accordingly, the plurality of conduits 27 further comprises a plurality of fluid conduits 40 and a plurality of air conduits 41. This conception includes at least one embodiment wherein the plurality of air conduits 41 and the plurality of air conduits 41 refer to the same physical component employed for varying purposes, depending on the needs of an individual operator at any given time. Further, the plurality of outlet heads 28 further comprises a plurality of fluid outlets 42 and a plurality of air outlets 43 as shown in FIG. 9. The plurality of fluid conduits 40 is connected between the plurality of fluid outlets 42 and the fluid pump 38, wherein the fluid pump 38 operably disperses any contents of the at least one fluid source 26 through the plurality of fluid outlets 42. This function constitutes any washing or lathering operations accomplished with the present invention, including any other assisted bathing operations as may be realized by a reasonably skilled individual. Adjacent to this functionality, the plurality of air conduits 41 is connected between the plurality of air outlets 43 and the air pump 39, wherein the air pump 39 disperses pressurized air from the plurality of air outlets 43. This arrangement enables the subjects to be air- or blow-dried from the same angles that fluid might be dispensed from, enabling a full-body touchless drying process.

Figure 2:
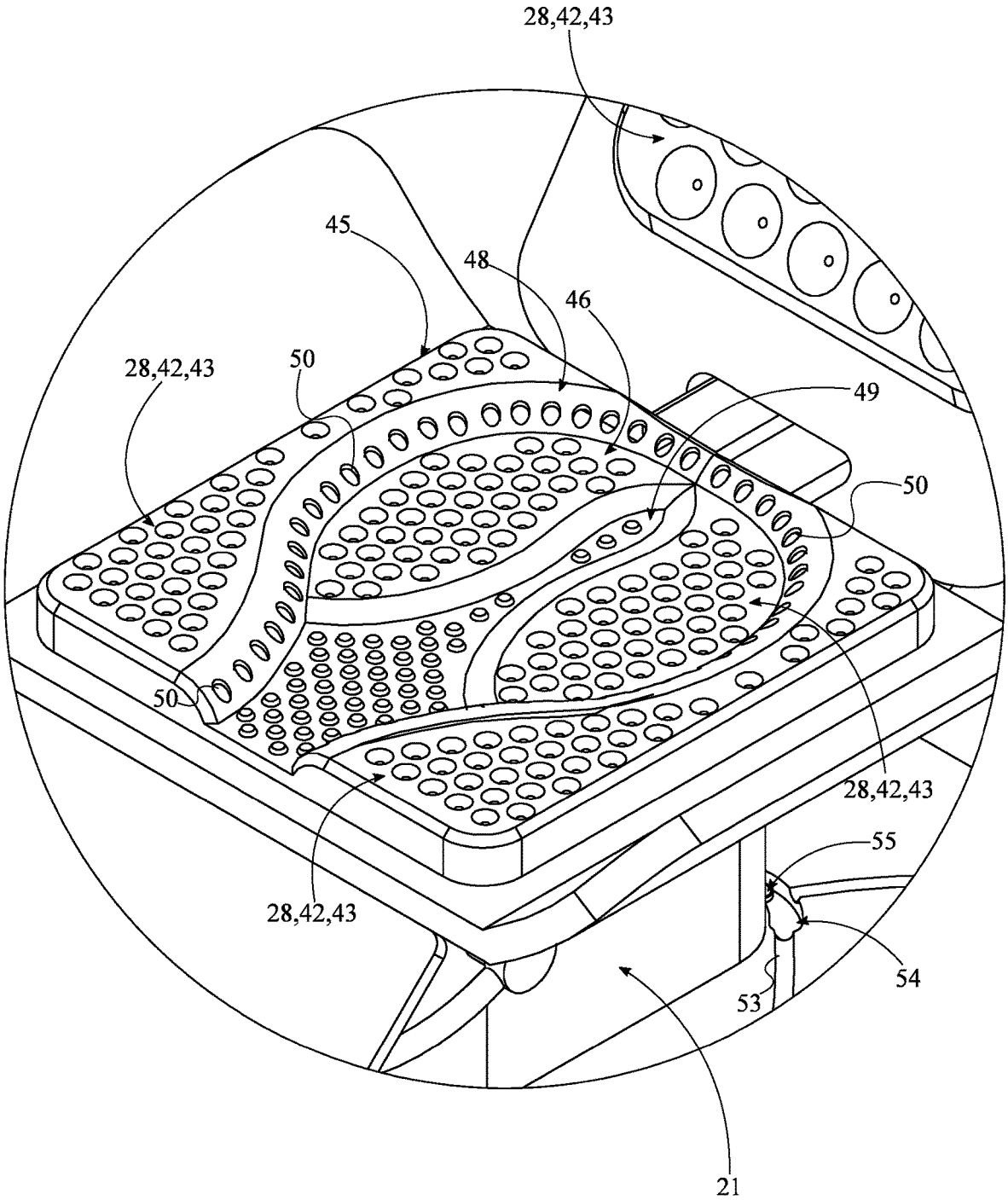
FIG. 2 is a detail view of area 2 from FIG. 1.

It is further recognized that the areas that are most critical to wash are often the most difficult to access, specifically, the groin, backside, and genital areas. In the case of assisted living facilities, washing these areas may be uncomfortable for both the care provider and the patient. Accordingly, the present invention further comprises a seat module 45 mounted to the base chair segment 22 as shown in FIGS. 1 and 2. The seat module 45 comprises a seat base 46, an ergonomic depression, a supporting platform, a lateral sidewall 48, a central culvert 49, and a plurality of perforations 50. The ergonomic depression is delineated by the lateral sidewall 48, wherein the ergonomic depression is shaped to conform to a human pelvic region. In practice, the ergonomic depression constitutes a sunken region approximating the profile of a subject's hips and buttocks, enabling the subject to sit down into the ergonomic depression to directly expose the genital area to the plurality of outlet heads 28 therein.

Further, the central culvert 49 is formed into the ergonomic depression to directly bracket a subject's genital region with appropriately scaled instances of the plurality of outlet heads 28 as shown in FIG. 2. Adjacent to this structure, the seat base 46 provides support for the subject's buttocks within the ergonomic depression while simultaneously raising the actual seating position above the outflow of 'grey' water flowing through the culvert. Accordingly, the seat base 46 is mounted to the lateral sidewall 48 across the ergonomic depression, above the central culvert 49. Additionally, the plurality of perforations 50 is formed through the lateral sidewall 48 with the plurality of perforations 50 being aligned with the plurality of outlet heads 28 on the base segment. This arrangement enables the sides and bottom of the subject's pelvic region to be washed directly, avoiding the potential issue of the lateral sidewall 48 creating a new inaccessible band of skin around the subject's thighs. Further, the plurality of perforations 50 prevents the creating of a seal between the ergonomic depression and the user's body by providing a route for pressure to equalize, thus preventing a potentially painful and embarrassing incident of a subject being stuck to the seat base 46 after a washing. Instead, a perfect seal is nigh-impossible to form with the plurality of perforations 50 occupying the most-likely sealing surface.

Figure 3:
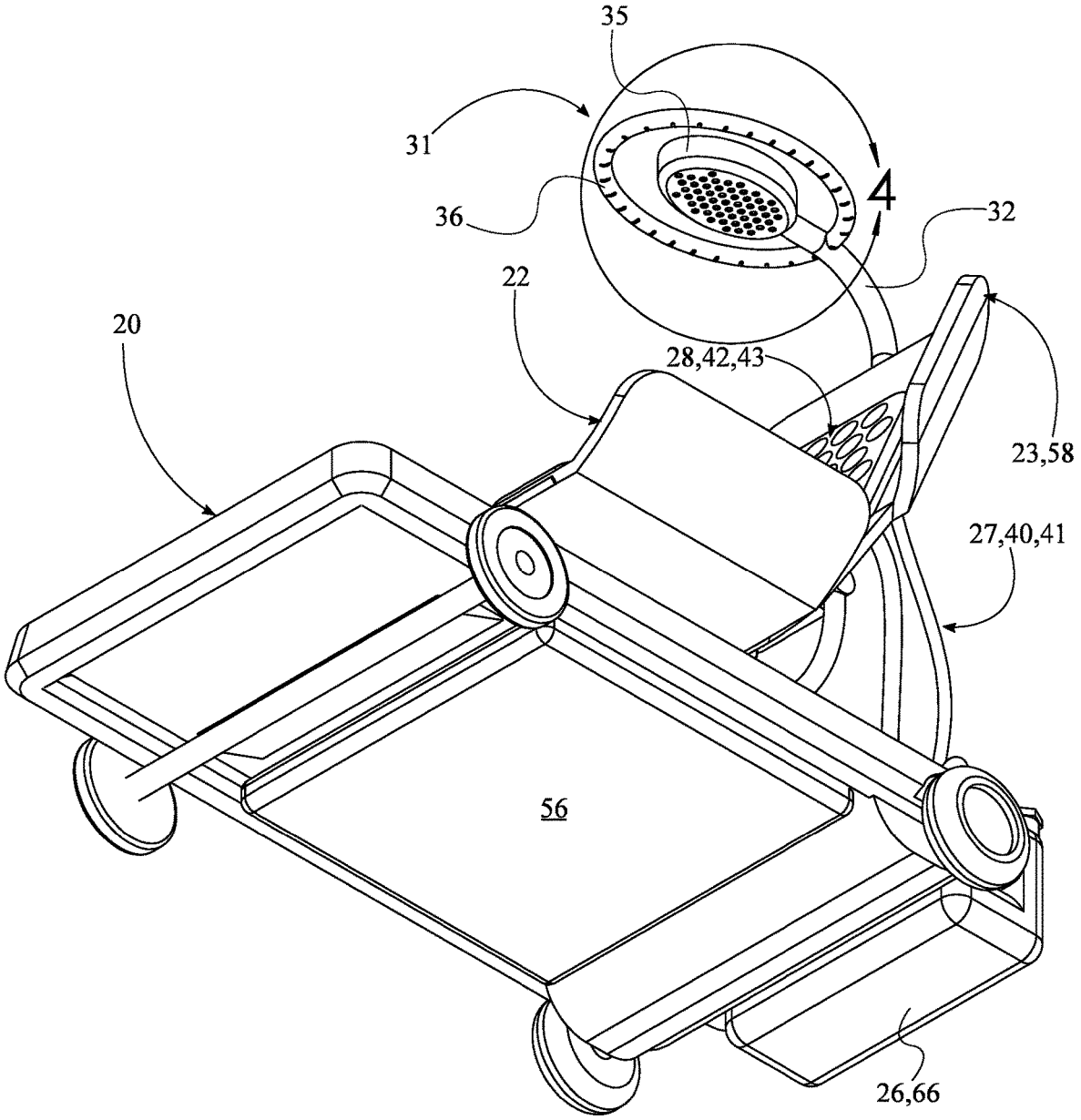
FIG. 3 is a bottom front left perspective view thereof.

In terms of efficiency, the present invention incorporates a variety of features and functionalities aimed at limiting water waste while still delivering an effective full-body wash. It is further considered that the present invention is configured to retain all wastewater and 'grey' (used) fluids after use. As indicated in FIGS. 3 and 5, the present invention further comprises a fluid reclamation system 52 comprising a plurality of channels 53, a collection drain 54, a return conduit 55, and a greywater reservoir 56. The collection drain 54 is mounted to the mobile chassis 20, wherein the collection drain 54 is in fluid communication with the greywater reservoir 56 through the return conduit 55 as shown in FIG. 7. The greywater reservoir 56 is ideally positioned on the lower extremis of the mobile chassis 20 to maintain a low center of gravity, and to ensure that all wastewater normally flows into the greywater reservoir 56 post-use. Accordingly, the plurality of channels 53 is distributed across the base chair segment 22 and the at least one articulated chair segment 23, wherein the plurality of channels 53 each terminate adjacent to the collection drain 54. Each of the plurality of channels 53 is configured with a slope or taper suitable for draining any pools of standing water or accumulated suds from the exposed areas of the present invention. Further, the mobile chassis 20 ideally defines a basin or similar structure to prevent spillage of any wastewater or debris. With the configuration shown in FIGS. 1 and 5, the mobile chassis 20 serves as a self-contained washing basin for the plurality of outlet heads 28 and the overhead module 31, enabling the present invention to be used in non-traditional settings that are typically not capable of supporting shower facilities. For example, the present invention may be brought directly into the living quarters of a mobility-compromised patient and used on-site, rather than relocating the patient to a designated showering area.

It is further considered that the present invention may be configured to provide support to a subject's legs and torso, whereby the supports are independently adjustable relative to the base chair segment 22. This positional flexibility enables the present invention to adapt to suit the comfort of an individual patient, while also enabling a caregiver to manipulate the subject's posture as necessary without manually adjusting the subject. As indicated in FIG. 1 the at least one articulated chair segment 23 is an upper chair segment 58 and a lower chair segment 59, generally corresponding to an upper-body support and a lower-body support respectively. The upper chair segment 58 is mounted to the adjustable armature 21 adjacent to the base chair segment 22 as shown in FIG. 8, enabling the upper chair segment 58 to be repositioned independent of either the base chair segment 22 or the lower chair segment 59. Additionally, the lower chair segment 59 is mounted to the adjustable armature 21 adjacent to the base chair segment 22, opposite the upper chair segment 58 across the base chair segment 22. The adjustable armature 21 is configurable to independently adjust the angle of the upper chair segment 58 and the lower chair segment 59 relative to the base chair segment 22. This three-body arrangement is ideally flexible across a range of angular relations, enabling a subject to be maneuvered through any posture from seated to nearly upright, according to their preferences and the needs of any onsite caregivers. In another instance, the upper chair segment 58, the base chair segment 22, and the lower chair segment 59 may be sequentially raised and tilted forward to assist a subject in standing upright, using the adjustable armature 21 as a lifting aid.

Although the invention has been explained in relation to its preferred embodiment, it is to be understood that many other possible modifications and variations can be made without departing from the spirit and scope of the invention as hereinafter claimed.

What is claimed is:

1. A portable body-washing apparatus comprising:

a mobile chassis;

an adjustable armature;

a base chair segment;

at least one articulated chair segment;

a pump assembly;

a power supply;

at least one fluid source;

a plurality of conduits;

a plurality of outlet heads;

a fluid selection mechanism;

the adjustable armature being mounted to the mobile chassis;

the base chair segment and the at least one articulated chair segment being mounted to the adjustable armature;

the relative position of the base chair segment and the at least one articulated chair segment to the mobile chassis being independently configurable;

the pump assembly being mounted to the mobile chassis, wherein the power supply is electrically connected to the pump assembly and wherein the pump assembly is in fluid communication with the at least one fluid source;

the plurality of outlet heads being distributed across the base chair segment and the at least one articulated chair segment;

the plurality of conduits being connected to the pump assembly;

each of the plurality of outlet heads being connected to one of the plurality of conduits, wherein plurality of outlet heads is in fluid communication with the at least one fluid source through the plurality of conduits; and the fluid selection mechanism being connected between the pump assembly and the at least one fluid source, wherein the fluid selection mechanism moderates input to the pump assembly from the at least one fluid source.

2. The portable body-washing apparatus as claimed in claim 1 comprising:

an overhead module;

elevated support;

at least one dedicated conduit from the plurality of conduits;

the elevated support being mounted to the at least one articulated chair segment, wherein the elevated support extends above the at least one articulated chair segment and the base chair segment;

the overhead module being mounted to the elevated support, opposite the at least one articulated segment; and the at least one dedicated conduit being connected between the overhead module the pump assembly through the elevated support.

3. The portable body-washing platform as claimed in claim 2 comprising:

the overhead module further comprising a central head and an outer ring;

the outer ring and the central head being mounted to the elevated support; and the central head being positioned within the outer ring.

4. The portable body-washing apparatus as claimed in claim 1 comprising:

the pump assembly further comprising a fluid pump and an air pump;

the plurality of conduits further comprising a plurality of fluid conduits and a plurality of air conduits;

the plurality of outlet heads further comprising a plurality of fluid outlets and a plurality of air outlets;

the plurality of fluid conduits being connected between the plurality of fluid outlets and the fluid pump, wherein the fluid pump operably disperses any contents of the at least one fluid source through the plurality of fluid outlets; and the plurality of air conduits being connected between the plurality of air outlets and the air pump, wherein the air pump disperses pressurized air from the plurality of air outlets.

5. The portable body-washing apparatus as claimed in claim 1 comprising:

a seat module being mounted to the base chair segment;

the seat module comprising a seat base, an ergonomic depression, a lateral sidewall, a central culvert, and a plurality of perforations;

the ergonomic depression being delineated by the lateral sidewall, wherein the ergonomic depression is shaped to conform to a human pelvic region;

the central culvert being formed into the ergonomic depression;

the seat base being mounted to the lateral sidewall across the ergonomic depression, above the central culvert;

the plurality of perforations being formed through the lateral sidewall; and the plurality of perforations being aligned with the plurality of outlet heads on the base segment.

6. The portable body-washing apparatus as claimed in claim 1 comprising:

a fluid reclamation system comprising a plurality of channels, a collection drain, a return conduit, and a greywater reservoir;

the collection drain being mounted to the mobile chassis, wherein the collection drain is in fluid communication with the greywater reservoir through the return conduit; and the plurality of channels being distributed across the base chair segment and the at least one articulated chair segment, wherein the plurality of channels each terminate adjacent to the collection drain.

7. The portable body-washing apparatus as claimed in claim 1 comprising:

the at least one articulated chair segment being an upper chair segment and a lower chair segment;

the upper chair segment being mounted to the adjustable armature adjacent to the base chair segment;

the lower chair segment being mounted to the adjustable armature adjacent to the base chair segment, opposite the upper chair segment across the base chair segment; and the adjustable armature being configurable to independently adjust the angle of the upper chair segment and the lower chair segment relative to the base chair segment.

8. The portable body-washing apparatus as claimed in claim 1 comprising:

each of the plurality of outlet heads further comprising a compressible housing, a nozzle plate, a plurality of air jets, and a plurality of fluid jets;

the nozzle plate being mounted into the compressible housing; and the plurality of air jets and the plurality of fluid jets being distributed across the nozzle plate, wherein the plurality of air jets and the plurality of fluid jets are in fluid communication with the pump assembly through the plurality of conduits.

9. The portable body-washing apparatus as claimed in claim 1 comprising:

the at least one fluid source being a portable reservoir, wherein the portable reservoir is mounted to the mobile chassis.

10. The portable body-washing apparatus as claimed in claim 1 comprising:

the power supply being a battery array, wherein the battery array is mounted to the mobile chassis.

11. A portable body-washing apparatus comprising:

a mobile chassis;

an adjustable armature;

a base chair segment;

at least one articulated chair segment;

a pump assembly;

a power supply;

at least one fluid source;

a plurality of conduits;

a plurality of outlet heads;

a fluid selection mechanism;

the adjustable armature being mounted to the mobile chassis;

the base chair segment and the at least one articulated chair segment being mounted to the adjustable armature;

the relative position of the base chair segment and the at least one articulated chair segment to the mobile chassis being independently configurable;

the pump assembly being mounted to the mobile chassis, wherein the power supply is electrically connected to the pump assembly and wherein the pump assembly is in fluid communication with the at least one fluid source;

the plurality of outlet heads being distributed across the base chair segment and the at least one articulated chair segment;

the plurality of conduits being connected to the pump assembly;

each of the plurality of outlet heads being connected to one of the plurality of conduits, wherein plurality of outlet heads is in fluid communication with the at least one fluid source through the plurality of conduits;

the fluid selection mechanism being connected between the pump assembly and the at least one fluid source, wherein the fluid selection mechanism moderates input to the pump assembly from the at least one fluid source;

a seat module being mounted to the base chair segment;

the seat module comprising a seat base, an ergonomic depression, a lateral sidewall, a central culvert, and a plurality of perforations;

the ergonomic depression being delineated by the lateral sidewall, wherein the ergonomic depression is shaped to conform to a human pelvic region;

the central culvert being formed into the ergonomic depression;

the seat base being mounted to the lateral sidewall across the ergonomic depression, above the central culvert;

the plurality of perforations being formed through the lateral sidewall; and the plurality of perforations being aligned with the plurality of outlet heads on the base segment;

the at least one fluid source being a portable reservoir, wherein the portable reservoir is mounted to the mobile chassis; and the power supply being a battery array, wherein the battery array is mounted to the mobile chassis.

12. The portable body-washing apparatus as claimed in claim 11 comprising:

an overhead module;

elevated support;

at least one dedicated conduit from the plurality of conduits;

the elevated support being mounted to the at least one articulated chair segment, wherein the elevated support extends above the at least one articulated chair segment and the base chair segment;

the overhead module being mounted to the elevated support, opposite the at least one articulated segment;

the at least one dedicated conduit being connected between the overhead module the pump assembly through the elevated support;

the overhead module further comprising a central head and an outer ring;

the outer ring and the central head being mounted to the elevated support; and the central head being positioned within the outer ring.

13. The portable body-washing apparatus as claimed in claim 1 comprising:

the pump assembly further comprising a fluid pump and an air pump;

the plurality of conduits further comprising a plurality of fluid conduits and a plurality of air conduits;

the plurality of outlet heads further comprising a plurality of fluid outlets and a plurality of air outlets;

the plurality of fluid conduits being connected between the plurality of fluid outlets and the fluid pump, wherein the fluid pump operably disperses any contents of the at least one fluid source through the plurality of fluid outlets; and the plurality of air conduits being connected between the plurality of air outlets and the air pump, wherein the air pump disperses pressurized air from the plurality of air outlets.

14. The portable body-washing apparatus as claimed in claim 1 comprising:

a fluid reclamation system comprising a plurality of channels, a collection drain, a return conduit, and a greywater reservoir;

the collection drain being mounted to the mobile chassis, wherein the collection drain is in fluid communication with the greywater reservoir through the return conduit; and the plurality of channels being distributed across the base chair segment and the at least one articulated chair segment, wherein the plurality of channels each terminate adjacent to the collection drain.

15. The portable body-washing apparatus as claimed in claim 1 comprising:

the at least one articulated chair segment being an upper chair segment and a lower chair segment;

the upper chair segment being mounted to the adjustable armature adjacent to the base chair segment;

the lower chair segment being mounted to the adjustable armature adjacent to the base chair segment, opposite the upper chair segment across the base chair segment; and the adjustable armature being configurable to independently adjust the angle of the upper chair segment and the lower chair segment relative to the base chair segment.

16. The portable body-washing apparatus as claimed in claim 1 comprising:

each of the plurality of outlet heads further comprising a compressible housing, a nozzle plate, a plurality of air jets, and a plurality of fluid jets;

the nozzle plate being mounted into the compressible housing; and the plurality of air jets and the plurality of fluid jets being distributed across the nozzle plate, wherein the plurality of air jets and the plurality of fluid jets are in fluid communication with the pump assembly through the plurality of conduits.

17. A portable body-washing apparatus comprising:

a mobile chassis;

an adjustable armature;

a base chair segment;

at least one articulated chair segment;

a pump assembly;

a power supply;

at least one fluid source;

a plurality of conduits;

a plurality of outlet heads;

a fluid selection mechanism;

the adjustable armature being mounted to the mobile chassis;

the base chair segment and the at least one articulated chair segment being mounted to the adjustable armature;

the relative position of the base chair segment and the at least one articulated chair segment to the mobile chassis being independently configurable;

the pump assembly being mounted to the mobile chassis, wherein the power supply is electrically connected to the pump assembly and wherein the pump assembly is in fluid communication with the at least one fluid source;

the plurality of outlet heads being distributed across the base chair segment and the at least one articulated chair segment;

the plurality of conduits being connected to the pump assembly;

each of the plurality of outlet heads being connected to one of the plurality of conduits, wherein plurality of outlet heads is in fluid communication with the at least one fluid source through the plurality of conduits;

the fluid selection mechanism being connected between the pump assembly and the at least one fluid source, wherein the fluid selection mechanism moderates input to the pump assembly from the at least one fluid source;

a seat module being mounted to the base chair segment;

the seat module comprising a seat base, an ergonomic depression, a lateral sidewall, a central culvert, and a plurality of perforations;

the ergonomic depression being delineated by the lateral sidewall, wherein the ergonomic depression is shaped to conform to a human pelvic region;

the central culvert being formed into the ergonomic depression;

the seat base being mounted to the lateral sidewall across the ergonomic depression, above the central culvert;

the plurality of perforations being formed through the lateral sidewall; and the plurality of perforations being aligned with the plurality of outlet heads on the base segment;

the at least one fluid source being a portable reservoir, wherein the portable reservoir is mounted to the mobile chassis;

the power supply being a battery array, wherein the battery array is mounted to the mobile chassis;

each of the plurality of outlet heads further comprising a compressible housing, a nozzle plate, a plurality of air jets, and a plurality of fluid jets;

the nozzle plate being mounted into the compressible housing;

the plurality of air jets and the plurality of fluid jets being distributed across the nozzle plate, wherein the plurality of air jets and the plurality of fluid jets are in fluid communication with the pump assembly through the plurality of conduits;

the at least one articulated chair segment being an upper chair segment and a lower chair segment;

the upper chair segment being mounted to the adjustable armature adjacent to the base chair segment;

the lower chair segment being mounted to the adjustable armature adjacent to the base chair segment, opposite the upper chair segment across the base chair segment; and the adjustable armature being configurable to independently adjust the angle of the upper chair segment and the lower chair segment relative to the base chair segment.

18. The portable body-washing apparatus as claimed in claim 11 comprising:

an overhead module;

elevated support;

at least one dedicated conduit from the plurality of conduits;

the elevated support being mounted to the at least one articulated chair segment, wherein the elevated support extends above the at least one articulated chair segment and the base chair segment;

the overhead module being mounted to the elevated support, opposite the at least one articulated segment;

the at least one dedicated conduit being connected between the overhead module the pump assembly through the elevated support;

the overhead module further comprising a central head and an outer ring;

the outer ring and the central head being mounted to the elevated support; and the central head being positioned within the outer ring.

19. The portable body-washing apparatus as claimed in claim 1 comprising:

the pump assembly further comprising a fluid pump and an air pump;

the plurality of conduits further comprising a plurality of fluid conduits and a plurality of air conduits;

the plurality of outlet heads further comprising a plurality of fluid outlets and a plurality of air outlets;

the plurality of fluid conduits being connected between the plurality of fluid outlets and the fluid pump, wherein the fluid pump operably disperses any contents of the at least one fluid source through the plurality of fluid outlets; and the plurality of air conduits being connected between the plurality of air outlets and the air pump, wherein the air pump disperses pressurized air from the plurality of air outlets.

20. The portable body-washing apparatus as claimed in claim 1 comprising:

a fluid reclamation system comprising a plurality of channels, a collection drain, a return conduit, and a greywater reservoir;

the collection drain being mounted to the mobile chassis, wherein the collection drain is in fluid communication with the greywater reservoir through the return conduit; and the plurality of channels being distributed across the base chair segment and the at least one articulated chair segment, wherein the plurality of channels each terminate adjacent to the collection drain.

* * * * *